US012215884B2

(12) United States Patent
Hjortland et al.

(10) Patent No.: US 12,215,884 B2
(45) Date of Patent: Feb. 4, 2025

(54) ENERGY EFFICIENT HEAT PUMP SYSTEMS AND METHODS

(71) Applicant: Johnson Controls Tyco IP Holdings LLP, Milwaukee, WI (US)

(72) Inventors: Andrew Leroy Hjortland, Stoughton, WI (US); Jeremy Ryan Smith, Park City, KS (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 0 days.

(21) Appl. No.: 18/503,980

(22) Filed: Nov. 7, 2023

(65) Prior Publication Data

US 2024/0151424 A1 May 9, 2024

Related U.S. Application Data

(60) Provisional application No. 63/423,388, filed on Nov. 7, 2022.

(51) Int. Cl.
*F24F 11/84* (2018.01)

(52) U.S. Cl.
CPC ..... *F24F 11/84* (2018.01)

(58) Field of Classification Search
CPC .. F25B 13/00; F25B 2600/2513; F25B 41/31; F25B 2700/1931; F25B 2313/029; F25B 2700/21152; F24F 11/84
See application file for complete search history.

(56) References Cited

U.S. PATENT DOCUMENTS

| | | | | |
|---|---|---|---|---|
| 2014/0305150 | A1 | 10/2014 | Kim et al. | |
| 2015/0267954 | A1* | 9/2015 | Ryu | F25B 49/02 62/504 |
| 2021/0055024 | A1* | 2/2021 | Hatomura | F25B 13/00 |
| 2023/0392843 | A1* | 12/2023 | Rite | F25B 13/00 |

FOREIGN PATENT DOCUMENTS

| | | | |
|---|---|---|---|
| CN | 102648383 | A | 8/2012 |
| EP | 4053470 | A1 | 9/2022 |
| KR | 20120085070 | A | 7/2012 |
| WO | 2022013982 | A1 | 1/2022 |

OTHER PUBLICATIONS

International Search Report and Written Opinion for PCT Application No. PCT/US2023/036951, mailed Mar. 6, 2024, 12 pages.

* cited by examiner

*Primary Examiner* — Nelson J Nieves
*Assistant Examiner* — Meraj A Shaikh
(74) *Attorney, Agent, or Firm* — Fletcher Yoder, PC

(57) ABSTRACT

An energy efficient heat pump for a heating, ventilation, and air conditioning (HVAC) system includes a working fluid circuit and a first conduit of the working fluid circuit, where the first conduit extends between a first heat exchanger and a second heat exchanger of the working fluid circuit. The energy efficient heat pump also includes a compressor disposed along the working fluid circuit, where the compressor is configured to direct a working fluid along the working fluid circuit, and the compressor includes a suction port and an injection port. The energy efficient heat pump further includes an injection conduit extending from the first conduit to the injection port of the compressor, where the injection conduit includes an expansion device, and the injection conduit is configured to direct a portion of the working fluid from the working fluid circuit, through the expansion device, and to the injection port.

20 Claims, 6 Drawing Sheets

ENERGY EFFICIENT HEAT PUMP SYSTEMS AND METHODS

CROSS-REFERENCE TO RELATED APPLICATIONS

This application claims priority from and the benefit of U.S. Provisional Patent Application No. 63/423,388, entitled "HEAT PUMP SYSTEMS AND METHODS," filed Nov. 7, 2022, which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Embodiments of the present disclosure are directed to heating, ventilation, and/or air conditioning (HVAC) systems configured to operate with reduced energy consumption and reduced greenhouse gas emissions. More particularly, embodiments of the present disclosure are directed to energy efficient heat pumps, including reverse cycle heat pumps and air-source heat pumps, configured to operate in a heating mode to heat a supply air flow in cold climate conditions with by utilizing intermediate fluid injection in a compressor, which improves efficiency, reduces energy consumption, and reduces generation of greenhouse gas emissions.

A heating, ventilation, and/or air conditioning (HVAC) system may be used to thermally regulate an environment, such as a space within a building, home, or other structure. The HVAC system generally includes a vapor compression system having heat exchangers, such as a condenser and an evaporator, which transfer thermal energy between the HVAC system and the environment. Typically, a compressor is fluidly coupled to a refrigerant circuit of the vapor compression system and is configured to circulate a refrigerant between the condenser and the evaporator. In this way, the compressor facilitates heat exchange between the refrigerant, the condenser, and the evaporator. In some cases, the HVAC system may be a heat pump configured to enable reversal of refrigerant flow through the refrigerant circuit. As such, the heat pump enables the condenser to operate as an evaporator (e.g., a heat absorber) and the evaporator to operate as a condenser (e.g., a heat rejector). Accordingly, the HVAC system may operate in multiple operating modes (e.g., a cooling mode, a heating mode) to provide both heating and cooling to the building with one refrigerant circuit. Unfortunately, conventional heat pump systems may operate with reduced efficiency in certain conditions.

SUMMARY

In an embodiment of the present disclosure, an energy efficient heat pump for a heating, ventilation, and air conditioning (HVAC) system includes a working fluid circuit and a first conduit of the working fluid circuit, where the first conduit extends between a first heat exchanger and a second heat exchanger of the working fluid circuit. The energy efficient heat pump also includes a compressor disposed along the working fluid circuit, where the compressor is configured to direct a working fluid along the working fluid circuit, and the compressor includes a suction port and an injection port. The energy efficient heat pump further includes an injection conduit extending from the first conduit to the injection port of the compressor, where the injection conduit includes an expansion device, and the injection conduit is configured to direct a portion of the working fluid from the working fluid circuit, through the expansion device, and to the injection port of the compressor to inject of the portion of the working fluid into the compressor.

In another embodiment, an energy efficient heat pump for a heating, ventilation, and air conditioning (HVAC) system includes a compressor disposed along a working fluid circuit, where the compressor includes a suction port configured to receive a first flow of working fluid from the working fluid circuit and an injection port configured to receive a second flow of working fluid from an injection conduit extending from the working fluid circuit to the injection port, where the injection port is disposed along the compressor downstream of the suction port relative to a flow direction of working fluid through the compressor. The energy efficient heat pump also includes an expansion device disposed along the injection conduit, where the expansion device is configured to reduce a temperature and a pressure of the second flow of working fluid directed to the injection port.

In a further embodiment, an energy efficient heat pump for a heating, ventilation, and air conditioning (HVAC) system includes a working fluid circuit and a compressor disposed along the working fluid circuit, where the compressor is configured to direct a working fluid along the working fluid circuit, and the compressor includes a suction port, a discharge port, and an injection port disposed between the suction port and the discharge port relative to a flow of the working fluid through the compressor. The energy efficient heat pump also includes an injection conduit extending from the working fluid circuit to the injection port, where the injection conduit includes an expansion device, and the injection conduit is configured to direct a portion of the working fluid from the working fluid circuit to the injection port, and a reversing valve disposed along the working fluid circuit, where the reversing valve is adjustable to direct the working fluid along the working fluid circuit in a first direction and to direct the working fluid along the working fluid circuit in a second direction, opposite the first direction.

DETAILED DESCRIPTION

Figure 1:
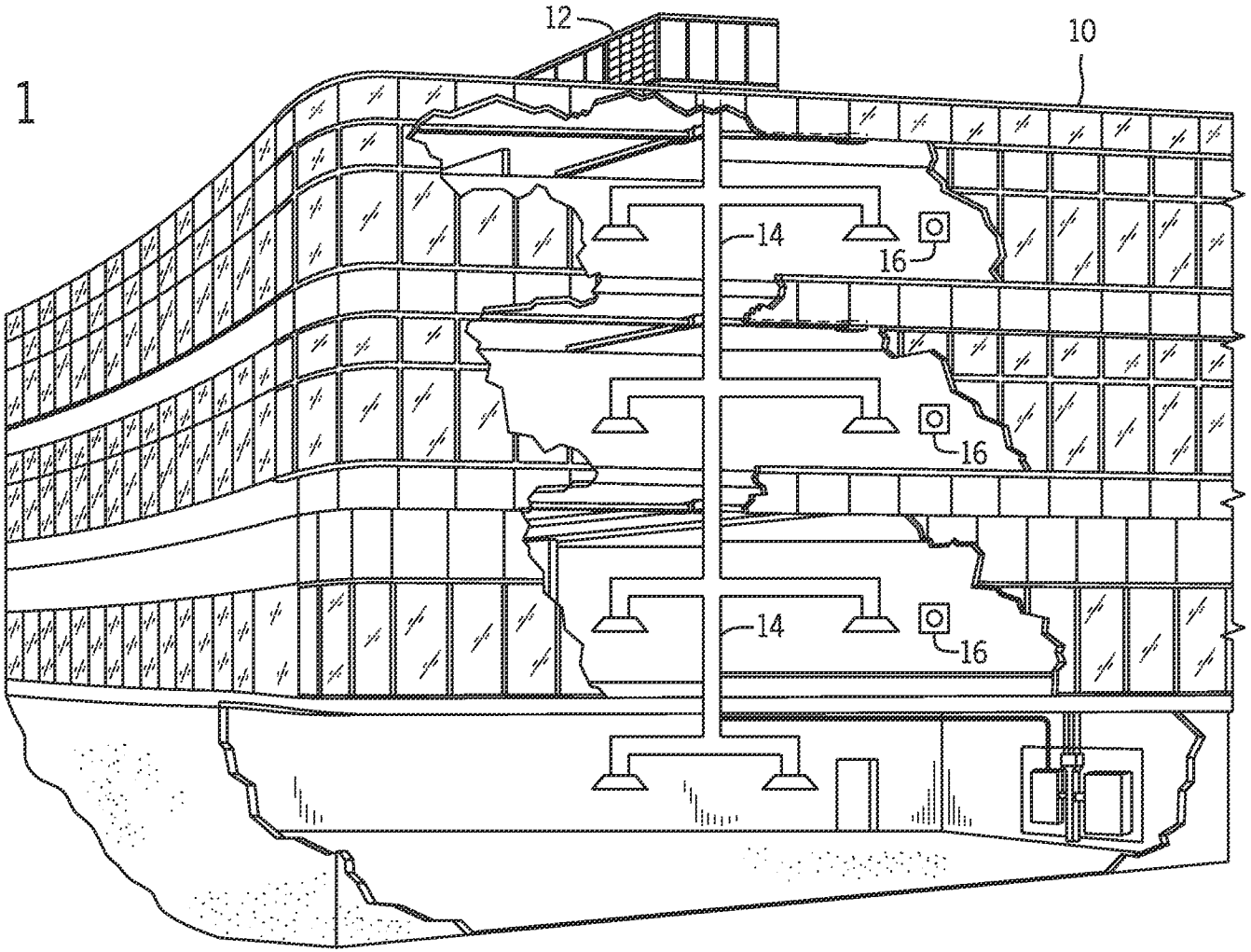
FIG. 1 is a perspective view of an embodiment of a building incorporating a heating, ventilation, and/or air conditioning (HVAC) system in a commercial setting, in accordance with an aspect of the present disclosure.

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "approximately," "generally," and "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to mean that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to mean that the given feature is within +/−5%, within +/−4%, within +/−3%, within +/−2%, within +/−1%, or even closer, to having the described nature, such as being parallel to another feature, being perpendicular to another feature, and so forth. Further, it should be understood that mathematical terms, such as "planar," "slope," "perpendicular," "parallel," and so forth are intended to encompass features of surfaces or elements as understood to one of ordinary skill in the relevant art, and should not be rigidly interpreted as might be understood in the mathematical arts. For example, a "planar" surface is intended to encompass a surface that is machined, molded, or otherwise formed to be substantially flat or smooth (within related tolerances) using techniques and tools available to one of ordinary skill in the art. Similarly, a surface having a "slope" is intended to encompass a surface that is machined, molded, or otherwise formed to be oriented at an angle (e.g., incline) with respect to a point of reference using techniques and tools available to one of ordinary skill in the art.

As briefly discussed above, a heating, ventilation, and/or air conditioning (HVAC) system may be used to thermally regulate a space within a building, home, or other suitable structure. For example, the HVAC system may include a vapor compression system that transfers thermal energy between a working fluid, such as a refrigerant, and a fluid to be conditioned, such as air. The vapor compression system includes heat exchangers, such as a condenser and an evaporator, which are fluidly coupled to one another via one or more conduits of a working fluid loop or circuit (e.g., refrigerant circuit). A compressor may be used to circulate the working fluid through the conduits and other components of the working fluid circuit (e.g., an expansion device) and, thus, enable the transfer of thermal energy between components of the working fluid circuit (e.g., between the condenser and the evaporator) and one or more thermal loads (e.g., an environmental air flow, a supply air flow). Additionally or alternatively, the HVAC system may include a heat pump (e.g., a heat pump system) having a first heat exchanger (e.g., a heating and/or cooling coil, an indoor coil, the evaporator) positioned within the space to be conditioned, a second heat exchanger (e.g., a heating and/or cooling coil, an outdoor coil, the condenser) positioned in or otherwise fluidly coupled to an ambient environment (e.g., the atmosphere), and a pump (e.g., the compressor) configured to circulate the working fluid (e.g., refrigerant) between the first and second heat exchangers to enable heat transfer between the thermal load (e.g., an air flow to be conditioned) and the ambient environment, for example. The heat pump system is operable to provide both cooling and heating to the space to be conditioned (e.g., a room, zone, or other region within a building) by adjusting a flow of the working fluid through the working fluid circuit. Thus, the heat pump may not include a dedicated heating system, such as a furnace or burner configured to combust a fuel, to enable operation of the HVAC system in the heating mode. As a result, the heat pump is configured to operate with reduced greenhouse gas emissions.

For example, during operation of the heat pump system in a cooling mode, the compressor may direct working fluid through the working fluid circuit and the first and second heat exchangers in a first flow direction. While receiving working fluid in the first flow direction, the first heat exchanger (which may be positioned within the space to be conditioned) may operate as an evaporator and, thus, enable working fluid flowing through the first heat exchanger to absorb thermal energy from an air flow directed to the space. Further, the second heat exchanger (which may be positioned in the ambient environment surrounding the heat pump system) may operate as a condenser to reject the heat absorbed by the working fluid flowing from the first heat exchanger (e.g., to an ambient air flow directed across the second heat exchanger). In this way, the heat pump system may facilitate cooling of the space or other thermal load serviced by (e.g., in thermal communication with) the first heat exchanger.

Conversely, during operation in a heating mode, a reversing valve (e.g., a switch-over valve) enables the compressor to direct working fluid through the working fluid circuit and the first and second heat exchangers in a second flow direction, opposite the first flow direction. While receiving working fluid in the second flow direction, the first heat exchanger may operate as a condenser instead of an evaporator, and the second heat exchanger may operate as an evaporator instead of a condenser. As such, the first heat exchanger may receive (e.g., from the second heat exchanger) a flow of heated working fluid to reject heat to thermal load serviced by the first heat exchanger (e.g., an air flow directed to the space) and, thus, facilitate heating of the thermal load. In this way, the heat pump system may facilitate either heating or cooling of the thermal load based on the current operational mode of the heat pump system (e.g., based on a flow direction of working fluid along the working fluid circuit).

Unfortunately, heat pumps may be susceptible to operational efficiencies in certain conditions or circumstances. For example, in many cases, pressure differentials or pressure ratios across various components (e.g., the compressor) or sections of the working fluid circuit may vary based on the mode (e.g., cooling, heating) in which the heat pump system operates. As an example, pressure ratios across the compressor of the working fluid circuit may be relatively small while the heat pump system operates in the cooling mode and may be relatively large while the heat pump system operates in the heating mode. Such pressure ratios may be indicative of a differential between an entering working fluid pressure at an inlet of the compressor and an exiting working fluid pressure at an outlet of the compressor. Compressors in existing heat pump systems may operate inefficiently at varying pressure differentials that may be encountered between operation in the cooling and heating modes of the heat pump system.

In some cases, certain compressors may be ill-suited and/or inefficient for certain HVAC system applications or conditions (e.g., based on amounts of heating and cooling typically desired in a particular HVAC system application). For example, a heating load of a heat pump may be greater in a cold climate than in a warm climate, but a cooling load of the heat pump in the same cold climate may be lower. In such applications, the heat pump may include a compressor that operates inadequately or inefficiently in a heating mode to satisfy a greater heating demand in the cold climate, but the compressor may operate adequately in a cooling mode. Alternatively, some heat pumps utilized in a cold climate may operate adequately in the heating mode but may operate inefficiently in the cooling mode.

Conventional approaches to address such shortcomings with heat pumps are typically expensive and complicated. Conventional approaches may also be associated with increased energy consumption and generation of greenhouse gas emissions. For example, in cold climate implementations, heat pumps may be implemented with auxiliary heating systems, such as electric heating systems or fuel combustion heating systems (e.g., furnaces), which add costs to the manufacture, maintenance, and operation of the HVAC system. Moreover, utilization of auxiliary heating systems, such as furnaces, generally results in the undesirable generation of greenhouse gas emissions. Other approaches include the incorporation of subcoolers, flash tanks, and/or other components with heat pumps, which also add manufacture, maintenance, and operation costs associated with the HVAC system. For at least the foregoing reasons, conventional HVAC systems utilizing heat pumps, particularly in cold climate environments, are inefficient, expensive, and/or susceptible to increased emissions. It is presently recognized that improved heat pump systems that mitigate or substantially eliminate the aforementioned shortcomings of conventional HVAC systems are desired.

Accordingly, embodiments of the present disclosure relate to a heat pump system that is configured to enable more efficient operation (e.g., in cold climate environments), enable reduction in costs associated with manufacturing, operating, and maintaining an HVAC system, and enable a reduction in the generation of greenhouse gas emissions. For example, present embodiments include energy efficient heat pump systems configured to operate in cold climate environments to satisfy heating demands without utilization of an auxiliary heating system, such as a furnace. In this way, the present techniques enable a reduction in energy consumption and a reduction in greenhouse gas emissions. As discussed in detail below, the heat pump system (e.g., reverse-cycle heat pump system, energy efficient heat pump) may include a compressor having an injection port (e.g., intermediate injection port) configured to receive a flow of vapor and/or liquid at an intermediate portion of the compressor (e.g., between a suction port and a discharge port of the compressor). In other words, the compressor is configured to receive a flow (e.g., a first flow, main flow) of working fluid (e.g., refrigerant) from the working fluid circuit (e.g., from a heat exchanger) of the heat pump system, and the compressor is also configured to receive a flow (e.g., a second flow, additional flow) of vapor and/or liquid working fluid via the injection port.

In accordance with present techniques, the flow of vapor and/or liquid directed to the injection port of the compressor may be directed from a section of the working fluid circuit different from a section of the working fluid circuit extending to a suction port of the compressor. As discussed above, the working fluid circuit may be configured to direct a flow of working fluid from the first heat exchanger to the second heat exchanger in one operating mode (e.g., cooling) and from the second heat exchanger to the first heat exchanger in another operating mode (e.g., heating). A portion of the flow of working fluid (e.g., liquid working fluid) may be directed from the working fluid circuit at a location between the first and second heat exchangers (e.g., a liquid line location) to an injection conduit extending from the location to the injection port of the compressor. An expansion device may be disposed along the injection conduit and may expand or "flash" the portion of the flow of working fluid to produce a vapor working fluid or a vapor and liquid mixture of working fluid. The portion of the flow of working fluid may then be injected into the compressor for compression with working fluid received by the compressor via the suction port of the compressor.

By injecting working fluid into the injection port of the compressor at an intermediate location of the compressor (e.g., between the suction port and the discharge port), various improvements and benefits may be provided. For example, the injected flow of working fluid may provide cooling to the compressor, which may enable more efficient operation of the compressor (e.g., reduced energy consumption). Cooling of the compressor via the injected flow of working fluid may also provide decreased working fluid discharge temperatures, which may extend an operating range of the compressor without adverse impact to an operating life (e.g., useful life) of the compressor. Additionally, by injecting working fluid into the compressor via the injection port and combining the injected working fluid with working fluid received via the suction port of the compressor, a mass flow rate of working fluid discharged by the compressor may be increased, which may increase an operating capacity of the particular heat exchanger that receives the discharged working fluid from the compressor in a particular operating mode of the heat pump system. The flow of working fluid injected into the compressor via the injection port may be controlled based on different variables and/or operating parameters of the heat pump system, as discussed in further detail below. Moreover, the present techniques enable injection of working fluid into the compressor in a desirable manner at significantly reduced costs (e.g., manufacturing costs, operating costs, maintenance costs). Thus, the present techniques enable improved operation and manufacture of heat pumps systems. Indeed, the present embodiments provide energy efficient heat pumps configured to operate and satisfy heating demands in cold climate conditions with reduced energy consumption and without operation of a furnace or other heating system configured to combust or consume a fuel, thereby enabling a reduction of greenhouse gas emissions.

It should be understood that one or more of the compressors included in the heat pump system may be fixed speed compressors, multi-stage (e.g., two stage) compressors, and/or variable speed compressors. Additionally, the present techniques may be incorporated with heat pump systems utilizing different types of compressors, such as rotary compressors, screw compressors, scroll compressors, and so forth. These and other features will be described below with reference to the drawings.

Turning now to the drawings, FIG. 1 illustrates an embodiment of a heating, ventilation, and/or air conditioning (HVAC) system for environmental management that employs one or more HVAC units in accordance with the present disclosure. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12 in accordance with present embodiments. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower and/or integrated air handler. In other embodiments, the HVAC unit 12 may be part of a split HVAC system, such as the system shown in FIG. 3, which includes an outdoor HVAC unit 58 and an indoor HVAC unit 56.

The HVAC unit 12 is an air-cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air flow, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
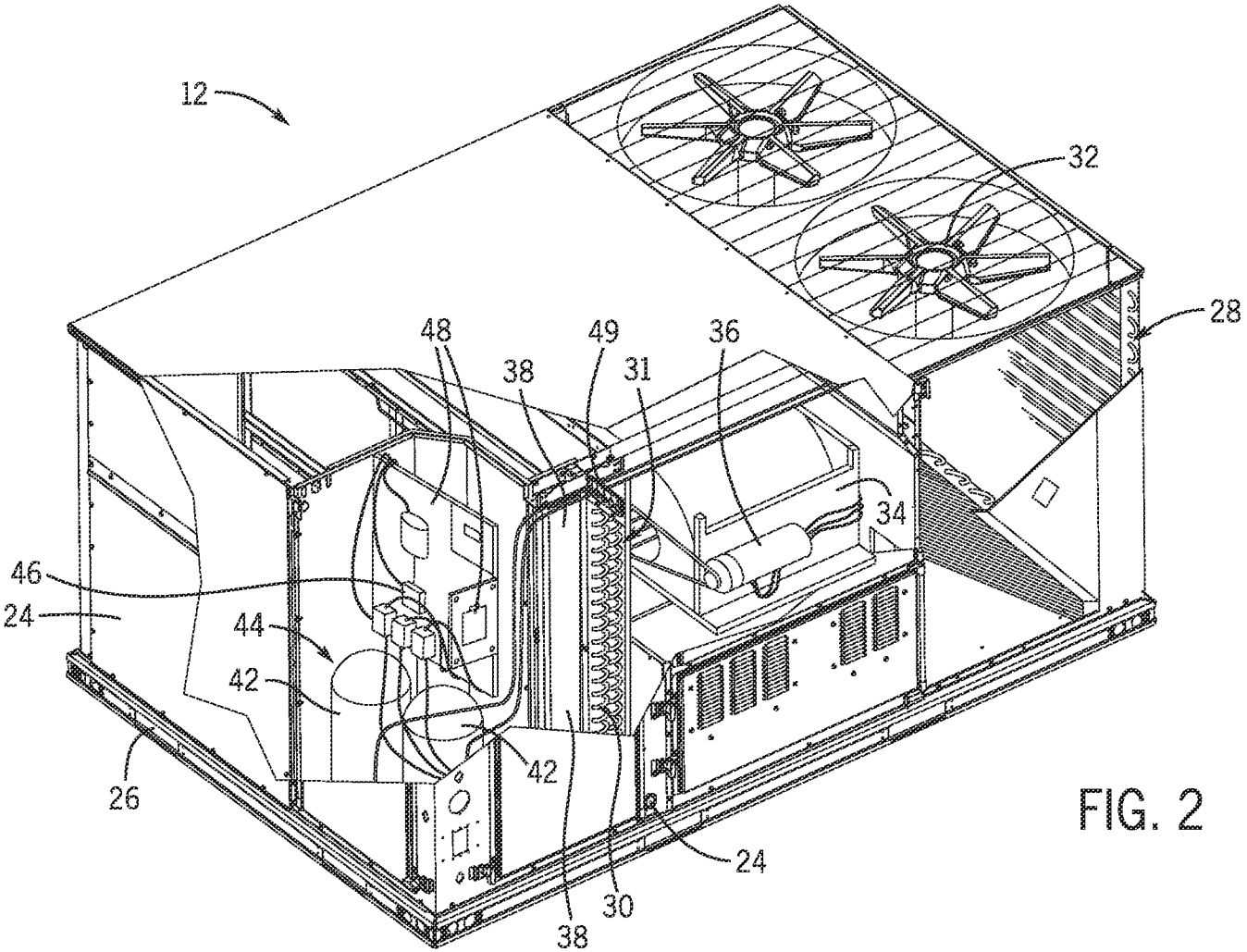
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent working fluid circuits and components that are tested, charged, wired, piped, and ready for installation. The HVAC unit 12 may provide a variety of heating and/or cooling functions, such as cooling only, heating only, cooling with dehumidification, heating with a heat pump, and/or cooling with a heat pump. As described above, the HVAC unit 12 may directly cool and/or heat an air flow provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more working fluid circuits. Tubes within the heat exchangers 28 and 30 may circulate a working fluid (e.g., refrigerant), such as R-454B and/or R32, through the heat exchangers 28 and 30. The tubes may be of various types, such as multichannel tubes, conventional copper or aluminum tubing, and so forth. Together, the heat exchangers 28 and 30 may implement a thermal cycle in which the working fluid undergoes phase changes and/or temperature changes as it flows through the heat exchangers 28 and 30 to produce heated and/or cooled air. For example, the heat exchanger 28 may function as a condenser where heat is released from the working fluid to ambient air, and the heat exchanger 30 may function as an evaporator where the working fluid absorbs heat to cool an air flow. In some embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the working fluid before the working fluid enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other components.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
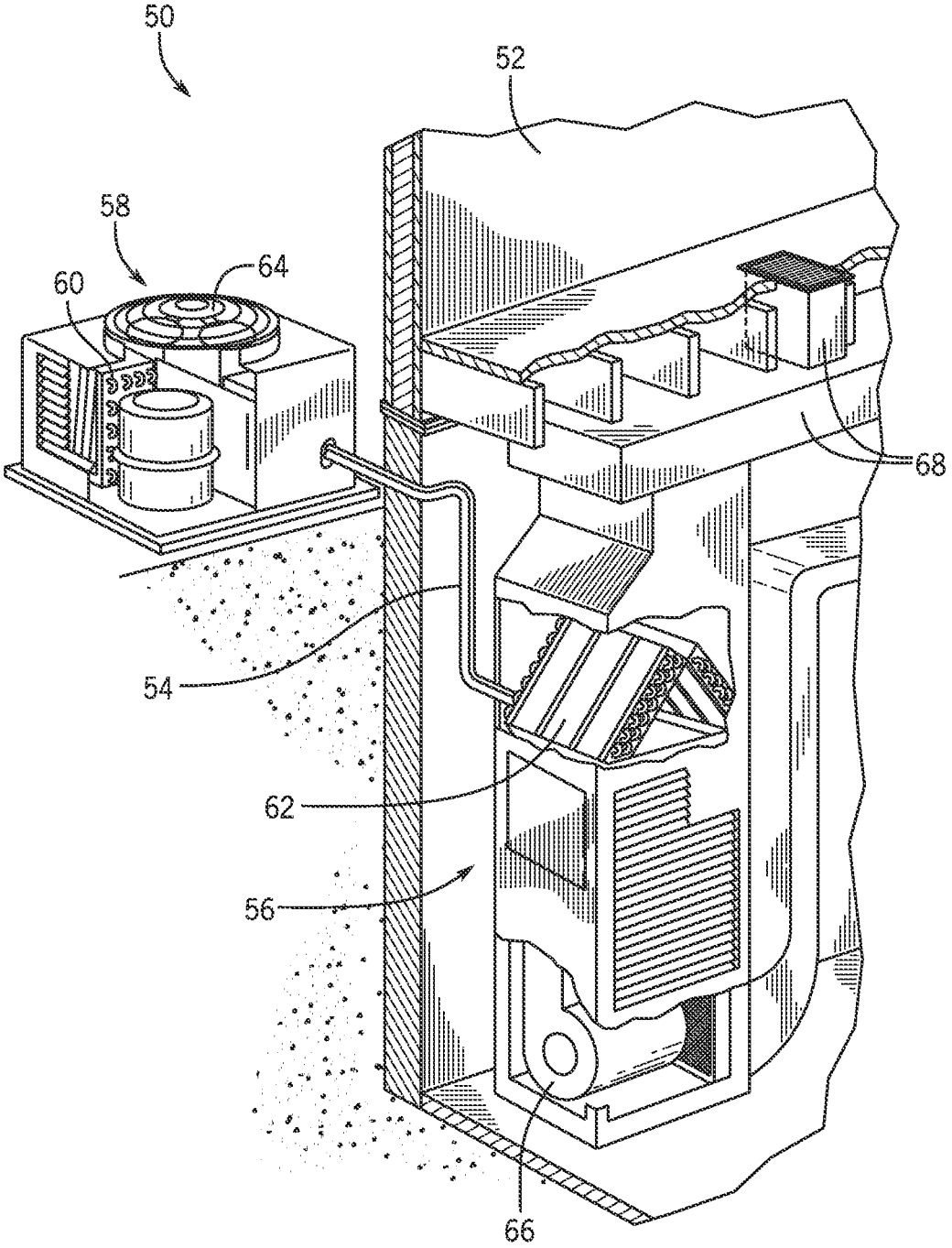
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include working fluid conduits 54 (e.g., refrigerant conduits) that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The working fluid conduits 54 transfer working fluid between the indoor unit 56 and the outdoor unit 58, typically transferring primarily liquid working fluid in one direction and primarily vaporized working fluid in an opposite direction.

When the system shown in FIG. 3 is operating as an air conditioner, a heat exchanger 60 in the outdoor unit 58 serves as a condenser for re-condensing vaporized working fluid flowing from the indoor unit 56 to the outdoor unit 58 via one of the working fluid conduits 54. In these applications, a heat exchanger 62 of the indoor unit functions as an evaporator. Specifically, the heat exchanger 62 receives liquid working fluid, which may be expanded by an expansion device, and evaporates the working fluid before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate working fluid and thereby cool air entering the outdoor unit 58 as the air passes over the outdoor heat exchanger 60. The indoor heat exchanger 62 will receive a stream of air blown over it and will heat the air by condensing the working fluid.

Figure 4:
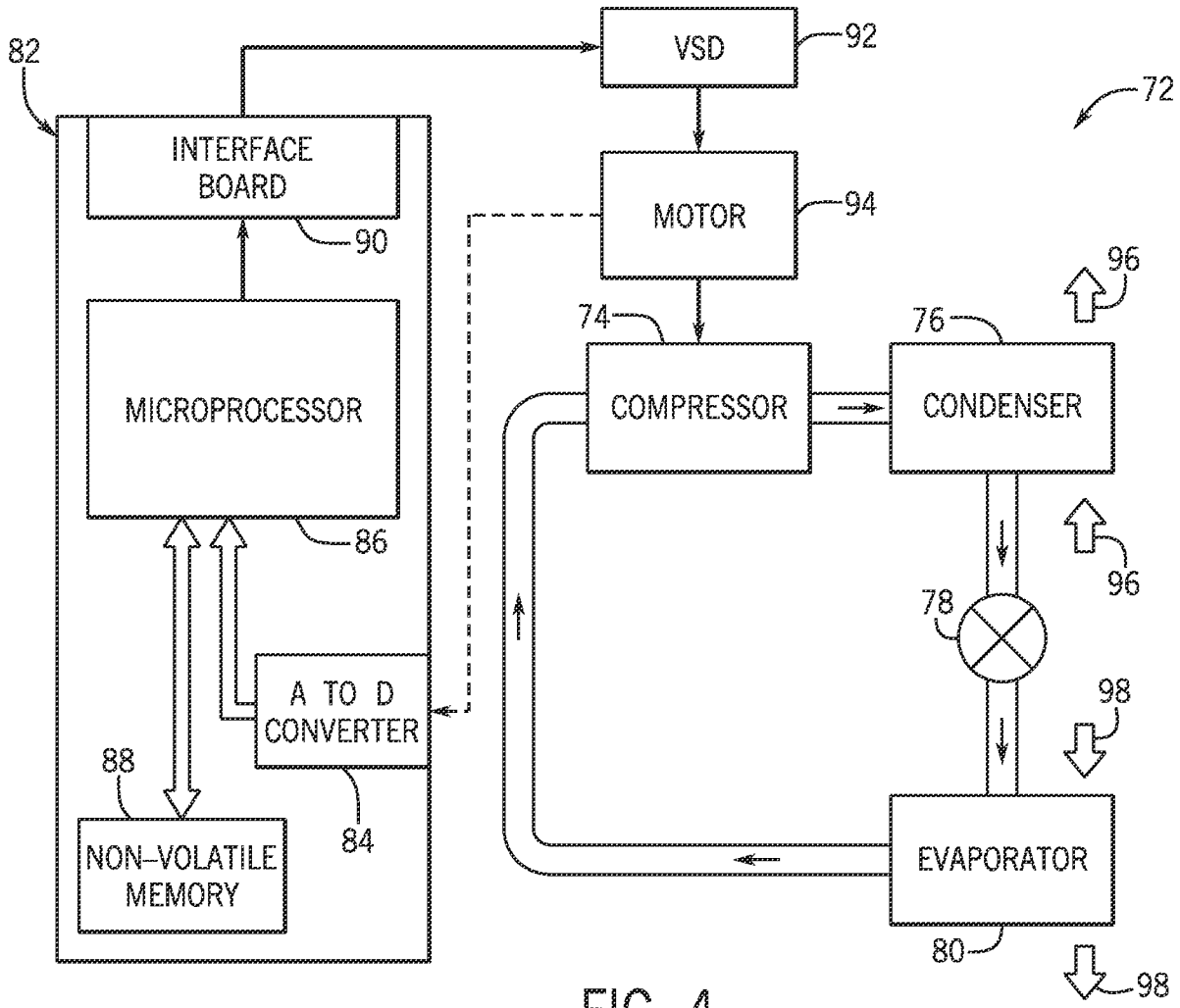
FIG. 4 is a schematic diagram of an embodiment of a vapor compression system used in an HVAC system, in accordance with an aspect of the present disclosure.

FIG. 4 is an embodiment of a vapor compression system 72 that can be used in any of the systems described above. The vapor compression system 72 may circulate a working fluid through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a working fluid vapor and delivers the vapor to the condenser 76 through a discharge passage. In some embodiments, the compressor 74 may be a centrifugal compressor, a scroll compressor, a screw compressor, a rotary compressor, or any other suitable type of compressor. The working fluid vapor delivered by the compressor 74 to the condenser 76 may transfer heat to a fluid passing across the condenser 76, such as ambient or environmental air 96. The working fluid vapor may condense to a working fluid liquid in the condenser 76 as a result of thermal heat transfer with the environmental air 96. The liquid working fluid from the condenser 76 may flow through the expansion device 78 to the evaporator 80.

The liquid working fluid delivered to the evaporator 80 may absorb heat from another air flow, such as a supply air flow 98 provided to the building 10 or the residence 52. For example, the supply air flow 98 may include ambient or environmental air, return air from a building, or a combination of the two. The liquid working fluid in the evaporator 80 may undergo a phase change from the liquid working fluid to a working fluid vapor. In this manner, the evaporator 80 may reduce the temperature of the supply air flow 98 via thermal heat transfer with the working fluid. Thereafter, the vapor working fluid exits the evaporator 80 and returns to the compressor 74 by a suction line to complete the cycle.

In some embodiments, the vapor compression system 72 may further include a reheat coil. In the illustrated embodiment, the reheat coil is represented as part of the evaporator 80. The reheat coil is positioned downstream of the evaporator heat exchanger relative to the supply air flow 98 and may reheat the supply air flow 98 when the supply air flow 98 is overcooled to remove humidity from the supply air flow 98 before the supply air flow 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air flow provided to a building or other load, embodiments of the present disclosure may be applicable to other HVAC systems as well. For example, the features described herein may be applied to mechanical cooling systems, free cooling systems, chiller systems, or other heat pump or refrigeration applications.

As briefly discussed above, embodiments of the present disclosure are directed to an HVAC system having an improved heat pump system. The heat pump system (e.g., reverse-cycle heat pump system, energy efficient heat pump) may include a compressor having an injection port configured to receive a flow of vapor and/or liquid working fluid at an intermediate portion of the compressor, such as between a suction port and a discharge port of the compressor. In other words, the compressor is configured to receive a first flow (e.g., primary flow) of working fluid from a heat exchanger (e.g., directly from the heat exchanger) of the heat pump system, and the compressor is also configured to receive a second flow (e.g., secondary flow) of vapor and/or liquid working fluid via the injection port. A combined flow of the first flow of working fluid and the second flow of working fluid is discharged via the discharge port of the compressor. By injecting working fluid into the injection port of the compressor at an intermediate location of the compressor, an amount of cooling is provided to the compressor, which may enable more efficient operation of the compressor. Additionally, injection of working fluid into the compressor via the injection port may increase a mass flow rate of working fluid discharged by the compressor, which may increase an operating capacity of the particular heat exchanger that receives the discharged working fluid from the compressor in a particular operating mode of the heat pump system. In the manners described below, the present techniques provide energy efficient heat pumps configured to operate and satisfy heating demands, such as in cold climate conditions, with improved efficiency, reduced energy consumption, and without operation of a furnace or other heating system configured to combust or consume a fuel, thereby enabling a reduction of greenhouse gas emissions.

Figure 5:
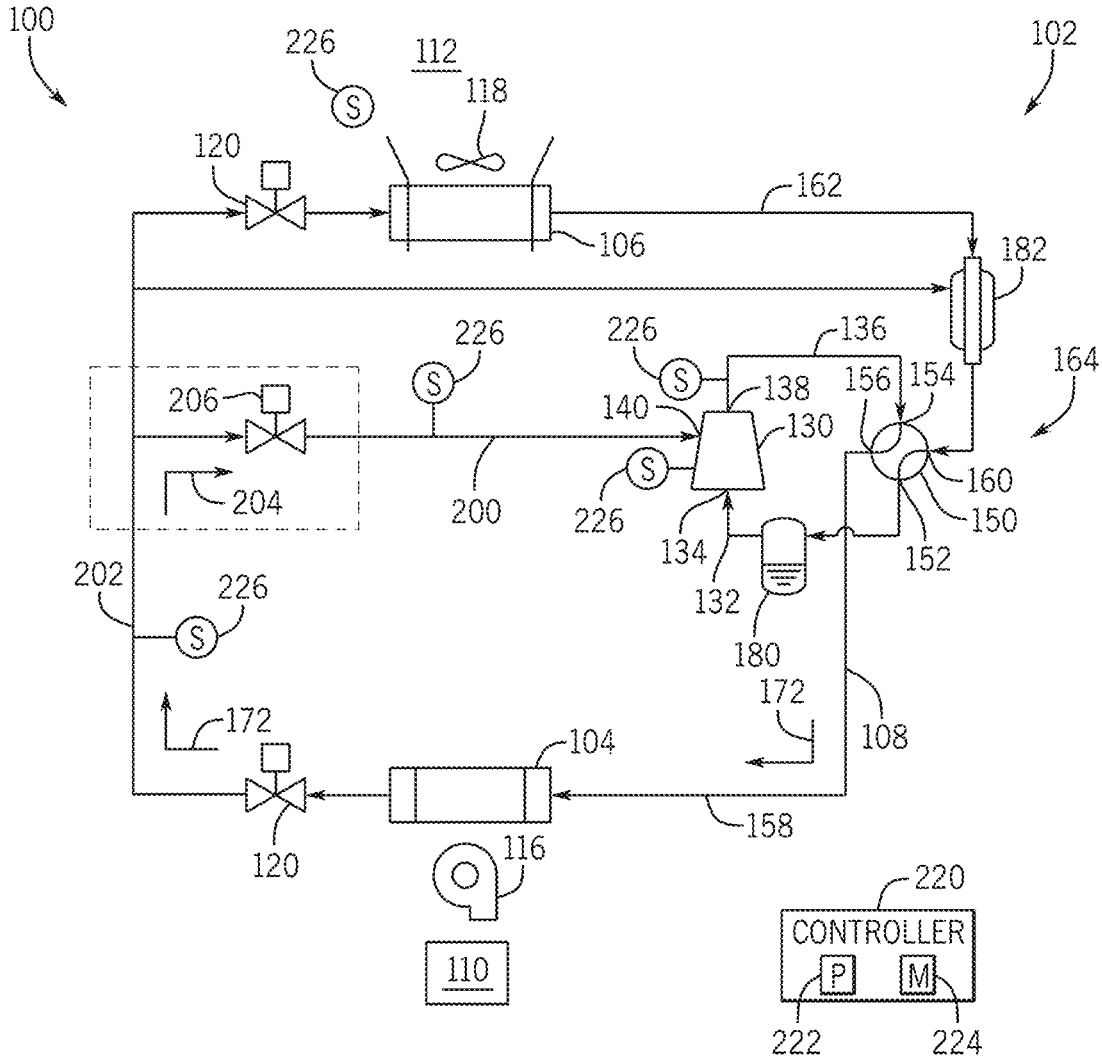
FIG. 5 is a schematic diagram of an embodiment of a portion of an HVAC system that includes a heat pump system, illustrating the heat pump system configured for operation in a heating mode, in accordance with an aspect of the present disclosure.

To provide context for the following discussion, FIG. 5 is a schematic of an embodiment of a portion of an HVAC system 100 that includes a heat pump 102 (e.g., a heat pump system, a reverse-cycle heat pump, an energy efficient heat pump) in accordance with present embodiments. The heat pump 102 may include one or more components of the vapor compression system 72 discussed above and/or may be included in any of the systems described above (e.g., the HVAC unit 12, the heating and cooling system 50). The heat pump 102 includes a first heat exchanger 104 and a second heat exchanger 106 that are fluidly coupled to one another via a working fluid circuit 108 or working fluid loop (e.g., one or more conduits, refrigerant circuit). The first heat exchanger 104 may be in thermal communication with (e.g., fluidly coupled to) a thermal load 110 (e.g., a room, space, and/or device) serviced by the heat pump 102, and the second heat exchanger 106 may be in thermal communication with an ambient environment 112 (e.g., the atmosphere, outdoor environment) surrounding the HVAC system 100.

In some embodiments, a first fan 116 (e.g., blower) may direct a first air flow across the first heat exchanger 104 to facilitate heat exchange between working fluid within the first heat exchanger 104 and the thermal load 110, while a second fan 118 may direct a second air flow across the second heat exchanger 106 to facilitate heat exchange between working fluid within the second heat exchanger 106 and the ambient environment 112. Thus, the heat pump 102 may be an air-source heat pump. One or more expansion devices 120 (e.g., an electronic expansion valve [EEV], a bi-directional expansion valve) may be disposed along the working fluid circuit 108 between the first heat exchanger 104 and the second heat exchanger 106 and may be configured to regulate (e.g., throttle) a flow of working fluid and/or a working fluid pressure differential between the first and second heat exchangers 104, 106.

The heat pump 102 also includes a compressor 130 (e.g., compressor system, positive displacement compressor) disposed along the working fluid circuit 108. The compressor 130 is configured to direct working fluid flow through the first heat exchanger 104, the second heat exchanger 106, and remaining components (e.g., the expansion device(s) 120) that may be fluidly coupled to the working fluid circuit 108. Although one compressor 130 is shown in the illustrated embodiment, the heat pump 102 may include any suitable quantity of compressors 130, such as two, three, four, five, six, or more than six compressors 130. The compressor 130 may be a fixed speed compressor, a multi-stage (e.g., two stage) compressor, and/or a variable speed compressor. Additionally, the compressor 130 may be a rotary compressor, a scroll compressor, a screw compressor, or any other suitable type of compressor (e.g., high-side shell compressor, positive displacement compressor).

The compressor 130 is configured to receive working fluid (e.g., a primary flow of working fluid) via a suction conduit 132 fluidly coupled to a suction port 134 of the compressor 130 and to discharge working fluid (e.g., compressed working fluid) via a discharge conduit 136 fluidly coupled to a discharge port 138 of the compressor 130. Further, the compressor 130 is also configured to receive an injected flow of working fluid (e.g., a secondary flow of working fluid) via one or more injection ports 140 of the compressor 130, as described in further detail below. As shown, the one or more injection ports 140 may be configured to direct the injected flow of working fluid into the compressor 130 at an intermediate location between the suction port 134 and the discharge port 138 of the compressor 130. That is, the one or more injection ports 140 are configured to direct the injected flow of working fluid into the compressor 130 downstream of the suction port 134 and upstream of the discharge port 138, relative to a flow direction of working fluid through the compressor 130. In some embodiments, the compressor 130 may include multiple injection ports 140 positioned at different intermediate locations along the compressor 130 (e.g., along a working fluid flow path of the compressor 130 from the suction port 134 to the discharge port 138).

The compressor 130 may be fluidly coupled to a remainder of the working fluid circuit 108 via a reversing valve 150 (e.g., a switch-over valve). In the illustrated embodiment, the reversing valve 150 includes a first port 152 that is fluidly coupled to the suction conduit 132, a second port 154 that is fluidly coupled to the discharge conduit 136, a third port 156 that is fluidly coupled to a first conduit portion 158 of the working fluid circuit 108 extending to the first heat exchanger 104, and a fourth port 160 that is fluidly coupled to a second conduit portion 162 of the working fluid circuit 108 extending to the second heat exchanger 106.

Figure 6:
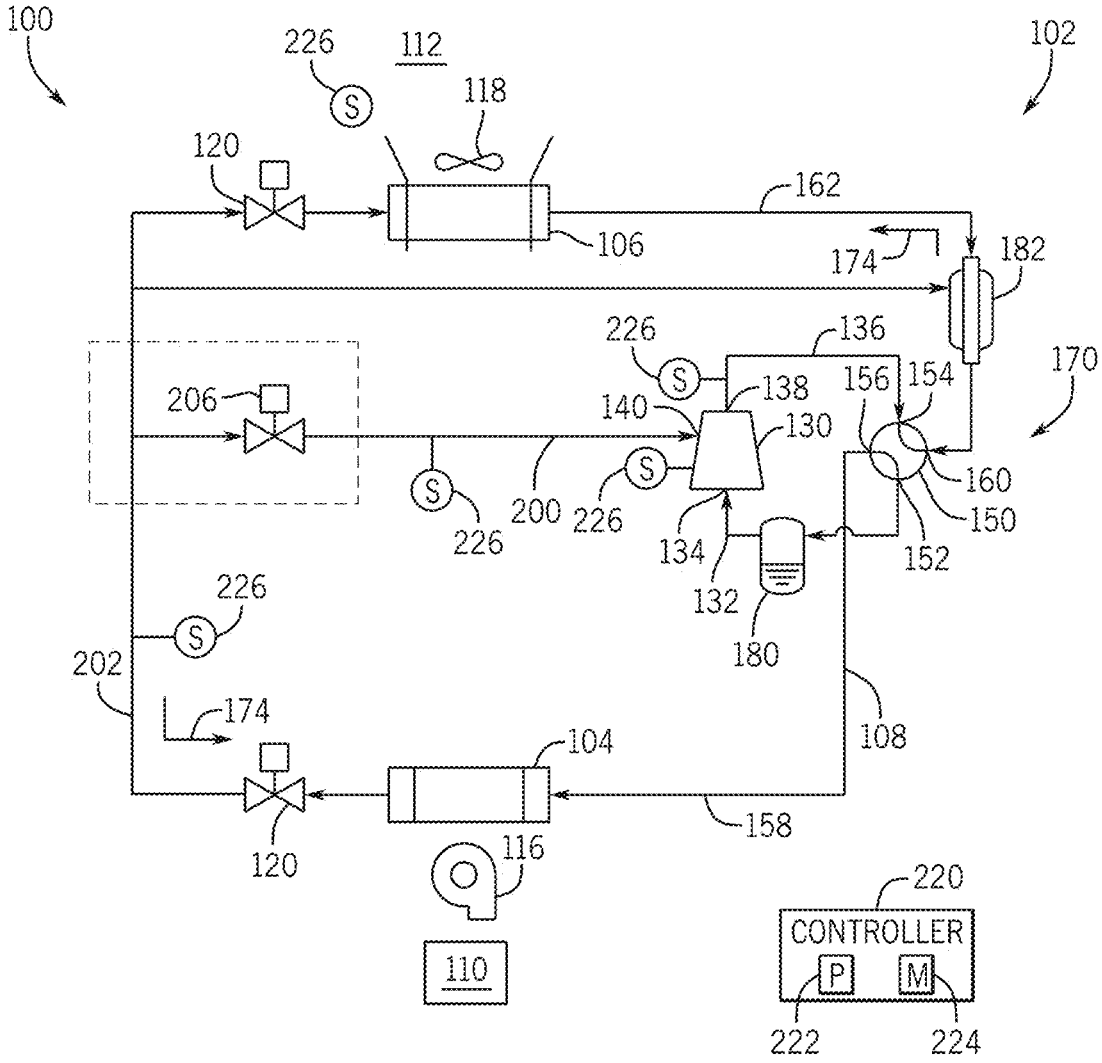
FIG. 6 is a schematic diagram of an embodiment of a portion of an HVAC system that includes a heat pump system, illustrating the heat pump system configured for operation in a cooling mode, in accordance with an aspect of the present disclosure.

The reversing valve 150 is configured to transition between a first configuration 164, in which the reversing valve 150 fluidly couples the first port 152 and the fourth port 160 and fluidly couples the second port 154 and the third port 156, and a second configuration 170 (FIG. 6), in which the reversing valve 150 fluidly couples the first port 152 and the third port 156 and fluidly couples the second port 154 and the fourth port 160. Accordingly, in the first configuration 164, the reversing valve 150 enables the compressor 130 to receive a flow of working fluid (e.g., via the suction port 134) from the second heat exchanger 106 and to discharge a flow of working fluid (e.g., via the discharge port 138) to the first heat exchanger 104. Conversely, in the second configuration 170, the reversing valve 150 enables the compressor 130 to receive a flow of working fluid (e.g., via the suction port 134) from the first heat exchanger 104 and to discharge a flow of working fluid (e.g., via the discharge port 138) to the second heat exchanger 106. In this way, while in the first configuration 164, the reversing valve 150 enables the heat pump 102 to operate in a heating mode, in which the first heat exchanger 104 rejects thermal energy to the thermal load 110 to heat the thermal load and the second heat exchanger 106 absorbs thermal energy from the ambient environment 112. Further, while in the second configuration 170, the reversing valve 150 enables the heat pump 102 to operate in a cooling mode, in which the first heat exchanger 104 absorbs thermal energy from the thermal load 110 to cool the thermal load and the second heat exchanger 106 rejects the absorbed thermal energy (e.g., absorbed from the thermal load 110) to the ambient environment 112. As such, while the reversing valve 150 is in the first configuration 164, the compressor 130 may direct a working fluid flow along at least a portion of the working fluid circuit 108 in a first flow direction 172. While the reversing valve 150 is in the second configuration 170, the compressor 130 may direct a working fluid flow along at least a portion of the working fluid circuit 108 in a second flow direction 174, opposite the first flow direction 172. For clarity, the heat pump 102 (e.g., energy efficient heat pump) is shown configured for operation in a heating mode in the illustrated embodiment of FIG. 5. Moreover, FIG. 6 is a schematic of an embodiment of a portion of the HVAC system 100 illustrating the heat pump 102 (e.g., energy efficient heat pump) configured for operation in a cooling mode.

The present discussion continues with reference to FIG. 5. The heat pump 102 may also include additional components, such as an accumulator 180 and/or a compensator 182. The accumulator 180 is generally configured to enable control of an amount of liquid working fluid circulating in the working fluid circuit 108. For example, the accumulator 180 may enable adjustment in the amount of liquid working fluid circulating in the working fluid circuit 108 in low ambient conditions (e.g., cold temperatures in the ambient environment 112). The compensator 182 may also be configured to enable control of an amount of working fluid circulating in the working fluid circuit 108. For example, the compensator 182 may be configured to retain a portion of working fluid therein during the heating mode of the heat pump 102, such that the portion of retained working fluid does not circulate through the working fluid circuit 108 (e.g., in the first flow direction 172), to improve operation of the heat pump 102 in the heating mode.

As mentioned above, the heat pump 102 is also configured to enable injection of working fluid into the compressor 130. Specifically, present embodiments include the heat pump 102 configured to divert a portion of working fluid within the working fluid circuit 108 and to inject the portion of working fluid into the compressor 130 via the injection port 140 of the compressor 130. To this end, the heat pump 102 (e.g., the working fluid circuit 108) includes an injection conduit 200 extending from a liquid conduit portion 202 (e.g., a third conduit portion) of the working fluid circuit 108 to the injection port 140 of the compressor 130. As shown, the liquid conduit portion 202 extends between the first heat exchanger 104 and the second heat exchanger 106. Thus, working fluid directed through the liquid conduit portion 202 may be in a liquid phase in both the heating mode and cooling mode of the heat pump 102. For example, in the heating mode, the working fluid may flow along the working fluid circuit 108 through (e.g., sequentially through) the first conduit portion 158, the first heat exchanger 104, the liquid conduit portion 202, the second heat exchanger 106, and the second conduit portion 162.

In the heating mode, liquid working fluid may be directed along the liquid conduit portion 202 (e.g., in the first flow direction 172) from the first heat exchanger 104 toward the second heat exchanger 106. As indicated by arrow 204, a portion the working fluid within the liquid conduit portion 202 may be diverted to the injection conduit 200 for injection into the compressor 130 via the injection port 140. The working fluid may be provided to the injection port 140 as a vapor working fluid or as a liquid-vapor mixture of working fluid. To this end, the heat pump 102 includes an expansion device 206 disposed along the injection conduit 200. For example, the expansion device 206 may be an electronic expansion valve (EEV), a modulating valve, a solenoid valve, a fixed orifice, a capillary tube, or a combination thereof. Thus, the expansion device 206 may operate to reduce a pressure and/or a temperature of (e.g., "flash") the portion of the working fluid directed from the liquid conduit portion 202 to the injection conduit 200, which may cause the working fluid within the injection conduit 200 to vaporize or partially vaporize. The expansion device 206 may also be controlled to enable adjustment of the flow of working fluid directed along the injection conduit 200 to the injection port 140 of the compressor 130, as discussed further below.

The HVAC system 100 may also include a controller 220 (e.g., a control system, a thermostat, a control panel, control circuitry, automation controller) that is communicatively coupled to one or more components of the heat pump 102 and is configured to monitor, adjust, and/or otherwise control operation of one or more components of the heat pump 102. For example, one or more control transfer devices, such as wires, cables, wireless communication devices, and the like, may communicatively couple the compressor 130, the expansion device(s) 120, the first and/or second fans 116, 118, the control device 16 (e.g., a thermostat), and/or any other suitable components of the HVAC system 100 to the controller 220. That is, the compressor 130, the expansion device(s) 120, the first and/or second fans 116, 118, and/or the control device 16 may each have one or more communication components that facilitate wired or wireless (e.g., via a network) communication with the controller 220. In some embodiments, the communication components may include a network interface that enables the components of the HVAC system 100 to communicate via various protocols such as EtherNet/IP, ControlNet, DeviceNet, or any other communication network protocol. Alternatively, the communication components may enable the components of the HVAC system 100 to communicate via mobile telecommunications technology, Bluetooth®, near-field communications technology, and the like. As such, the controller 220, the compressor 130, the expansion device(s) 120, the first and/or second fans 116, 118, and/or the control device 16 may wirelessly communicate data between each other. In other embodiments, operational control of certain components of the heat pump 102 may be regulated by one or more relays or switches (e.g., a 24 volt alternating current [VAC] relay).

In some embodiments, the controller 220 may be a component of or may include the control panel 82. In other embodiments, the controller 220 may be a standalone controller, a dedicated controller, or another suitable controller included in the HVAC system 100. In any case, the controller 220 is configured to control components of the HVAC system 100 in accordance with the techniques discussed herein. The controller 220 includes processing circuitry 222, such as a microprocessor, which may execute software for controlling the components of the HVAC system 100. The processing circuitry 222 may include multiple microprocessors, one or more "general-purpose" microprocessors, one or more special-purpose microprocessors, and/or one or more application specific integrated circuits (ASICS), or some combination thereof. For example, the processing circuitry 222 may include one or more reduced instruction set (RISC) processors.

The controller 220 may also include a memory device 224 (e.g., a memory) that may store information, such as instructions, control software, look up tables, configuration data, etc. The memory device 224 may include a volatile memory, such as random access memory (RAM), and/or a nonvolatile memory, such as read-only memory (ROM). The memory device 224 may store a variety of information and may be used for various purposes. For example, the memory device 224 may store processor-executable instructions including firmware or software for the processing circuitry 222 execute, such as instructions for controlling components of the HVAC system 100 (e.g., the heat pump 102). In some embodiments, the memory device 224 is a tangible, non-transitory, machine-readable-medium that may store machine-readable instructions for the processing circuitry 222 to execute. The memory device 224 may include ROM, flash memory, a hard drive, or any other suitable optical, magnetic, or solid-state storage medium, or a combination thereof. The memory device 224 may store data, instructions, and any other suitable data.

In accordance with present techniques, the controller 220 may also be configured to control operation of the expansion device 206 disposed along the injection conduit 200. In particular, the controller 220 may regulate operation of the expansion device 206 to control flow of the working fluid through the injection conduit 200 to the injection port 140. Indeed, the expansion device 206 may be controlled to adjust one or more properties of the working fluid injected into the compressor 130 (e.g., via the injection port 140), such as a flow rate, a temperature, a pressure, a phase, or other attribute of the working fluid. The controller 220 may also regulate operation of the expansion device 206 to achieve other operating parameters (e.g., target operating parameters) of the heat pump 102. For example, the heat pump 102 may include one or more sensors 226 configured to detect one or more operating parameters of the heat pump 102, and the controller 220 may control operation of the expansion device 206 (e.g., adjust a position of the expansion device 206) based on feedback received from the one or more sensors 226. The one or more sensors 226 may be configured to detect any suitable operating parameter associated with the heat pump 102, such as temperature, pressure, flow rate, and so forth.

In some embodiments, one or more of the sensors 226 may be disposed along the discharge conduit 136 and may be configured to detect a temperature and/or a pressure (e.g., operating parameter) of working fluid discharged by the compressor 130. In such embodiments, the controller 220 may control operation of the expansion device 206 to adjust flow of working fluid injected into the compressor 130 via the injection port 140 to achieve a desired temperature and/or pressure of the working fluid (e.g., desired superheat, desired discharge temperature, desired operating parameter value) discharged by the compressor 130. In some embodiments, the controller 220 may control operation of the expansion valve 206 based on other parameters, such as a speed of the compressor 130, a stage of the compressor 130, an operating mode of the heat pump 102, a set point temperature of a space conditioned by the heat pump 102, a detected temperature of the space conditioned by the heat pump 102, a temperature of the ambient environment 112, and so forth. For example, the controller 220 may be configured to operate the expansion device 206 to enable injection of working fluid into the compressor 130 via the injection port 140 during operation of the compressor 130 at an upper speed limit (e.g., highest speed, full capacity).

The working fluid within the injection conduit 200 may be injected into the compressor 130 via the injection port 140 to enable improved operation of the heat pump 102. For example, present embodiments may enable improved operation of the heat pump 102 in cold climate conditions (e.g., cold temperatures of the ambient environment 112) that may also coincide with increased demands for heating by the heat pump 102 (e.g., increase demand of the thermal load 110). As will be appreciated, in cold climate conditions, a discharge temperature and/or discharge superheat of the working fluid discharged by the compressor 130 may be greater than desired (e.g., in the heating mode of the heat pump 102) Accordingly, the heat pump 102 may operate to direct vapor working fluid and/or a vapor-liquid mixture of working fluid into the compressor 130 via the injection conduit 200 and injection port 140, which may cause cooling of working fluid within the compressor 130 and reduce the discharge temperature and/or superheat of the working fluid discharged by the compressor 130. The injected working fluid may also cause cooling of the compressor 130. In this way, the present techniques may enable improved operation of the heat pump 102 in cold climate conditions. For example, present embodiments enable improved operation of the heat pump 102 during periods of compressor 130 operation at greater pressure ratios.

In some embodiments, the disclosed techniques may enable an increase in operating efficiency of the compressor 130 and the heat pump 102. As will be appreciated, operation of the compressor 130 with greater efficiency may enable operation of the heat pump 102 with reduced energy consumption. Indeed, as discussed above, the controller 220 may adjust operation of the expansion device 206 based on feedback from one or more of the sensors 226, whereby the feedback is indicative of the superheat or discharge temperature of the discharged working fluid. In some embodiments, the one or more sensors 226 may include a pressure transducer and a temperature sensor disposed along the discharge conduit 136, feedback from the pressure transducer and the temperature sensor may be received by the controller 220, and the controller 220 may determine a discharge temperature and/or superheat of the working fluid discharged by the compressor 130.

The controller 220 may control the expansion device 206 such that the discharged working fluid achieves a particular discharge superheat or temperature (e.g., set point, set point value) and/or does not exceed a particular discharge superheat or discharge temperature (e.g., set point, set point value). A set point of the desired discharge superheat or discharge temperature may be based on a particular embodiment of the heat pump 102, a particular embodiment or type of the compressor 130, or other suitable parameter. In some embodiments, the set point of the desired discharge superheat or discharge temperature may be stored in the memory device 224. The controller 220 may be configured to receive feedback from one of the sensors 226 indicative of the discharge superheat or discharge temperature of the working fluid, compare the feedback to the set point (e.g., set point value) stored in the memory device 224, and adjust operation of the expansion device 206 to cause the measured discharge superheat or discharge temperature to approach the set point discharge superheat or discharge temperature.

Additionally or alternatively, the injection conduit 200 and expansion device 206 may be utilized and/or controlled to increase an operating capacity of the compressor 130, the first heat exchanger 104, the second heat exchanger 106, and/or the heat pump 102 generally. As mentioned above, the working fluid injected into the compressor 130 via the injection port 140 (e.g., secondary flow of working fluid) is combined with a primary flow of working fluid received via the suction port 134 in the compressor 130. Thus, a mass flow rate of working fluid discharged by the compressor 130 may be greater that a mass flow rate of working fluid received by the compressor 130 via the suction port 134. In some instances, the increase in mass flow rate of working fluid discharged by the compressor 130 may enable an increase in a heating capacity of the heat pump 102 (e.g., the first heat exchanger 104) in the heating mode of the heat pump 102. As will be appreciated, the increased heating capacity of the heat pump 102 (e.g., the first heat exchanger 104) in the heating mode may enable the heat pump 102 to satisfy greater heating loads in cold climates without utilization of an auxiliary heating system, such as a furnace that combusts a fuel to provide supplemental. In this way, present embodiments enable a reduction in the generation of greenhouse gas emissions.

It should be appreciated that techniques similar to those described above may be utilized during operation of the heat pump 102 in the cooling mode of the heat pump 102. In some instances, it may be desirable (e.g., based on feedback from the one or more sensors 226) to block flow of working fluid along the injection conduit 200 and therefore block injection of working fluid into the compressor 130 via the injection port 140. For example, at certain temperatures of the ambient environment 112, it may be desirable to block injection of working fluid into the compressor 130 via the injection port 140. In such instances, for example, the controller 220 may adjust the expansion device 206 to a closed position. In other embodiments, the expansion device 206 may include a fixed orifice or capillary tube and a solenoid valve, and the solenoid valve may be adjusted to a closed position to block working fluid flow to the injection port 140. At other temperatures of the ambient environment 112 (e.g., higher temperatures), it may be desirable to enable injection of working fluid into the compressor 130 via the injection port 140.

In some embodiments, one of the sensors 226 may be configured to detect a temperature of the ambient environment 112 and provide feedback indicative of the temperature to the controller 220. The controller 220 may compare the feedback indicative of the temperature to a set point temperature (e.g., stored in the memory device 224) and adjust a position of the expansion device 206 based on the comparison. For example, the set point temperature may be approximately 90 degrees Fahrenheit. In response to a determination that the temperature of the ambient environment 112 is at or above the set point temperature, the controller 220 may adjust the expansion device 206 toward an open position to enable injection of working fluid into the compressor 130 via the injection port 140. In response to a determination that the temperature of the ambient environment 112 is below the set point temperature, the controller 220 may adjust the expansion device 206 toward a closed position to block injection of working fluid into the compressor 130 via the injection port 140. Additionally or alternatively, in the cooling mode, the controller 220 may control and/or adjust a position of the expansion device 206 (e.g., based on feedback from one or more of the sensors 226) to achieve a desired discharge superheat and/or discharge temperature, in the manner similarly described above.

As discussed above, present embodiments also enable more efficient operation of the heat pump 102 with reduced energy consumption and reduced emissions at significantly reduced costs. For example, the present techniques enable more efficient operation of the heat pump 102 in cold climate conditions, during operation of the compressor 130 at higher pressure ratios, and so forth, at reduced costs compared to traditional systems. Indeed, it will be appreciated that the injection conduit 200 and the expansion device 206 may be implemented at a reduced cost compared to traditional systems incorporating more expensive and more complicated components.

As set forth above, embodiments of the present disclosure may provide one or more technical effects useful for enabling operation of a heat pump system in both a cooling mode and a heating mode in cold climate conditions. Indeed, implementation of the disclosed heat pump system (e.g., energy efficient heat pump) with the injection conduit and expansion device may enable operation of a compressor at higher pressure ratios, improve an overall operational efficiency of an HVAC system during cooling and heating operations, improve an operating capacity of the HVAC system, as well as reduce costs and complexity associated with manufacture, operation, and/or maintenance of the HVAC system. As a result, the present techniques enable utilization of heat pumps (e.g., without auxiliary heating systems, such as furnaces) to satisfy greater demands (e.g., heating demands) with reduced energy consumption and reduced greenhouse gas emissions. It should be understood that the technical effects and technical problems in the specification are examples and are not limiting. Indeed, it should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An energy efficient heat pump for a heating, ventilation, and air conditioning (HVAC) system, comprising:

a working fluid circuit;

a first conduit of the working fluid circuit, wherein the first conduit extends between a first heat exchanger and a second heat exchanger of the working fluid circuit;

a compressor disposed along the working fluid circuit, wherein the compressor is configured to direct a working fluid along the working fluid circuit, and the compressor comprises a suction port, a first injection port, and a second injection port;

an injection conduit extending from the first conduit to the first injection port and the second injection port of the compressor, wherein the injection conduit comprises an expansion device, and the injection conduit is configured to direct a portion of the working fluid from the working fluid circuit, through the expansion device, and to the first injection port and the second injection port of the compressor to inject the portion of the working fluid into the compressor;

a first sensor configured to detect an ambient temperature; and a controller communicatively coupled to the first sensor and to the expansion device, wherein the controller is configured to:

receive feedback from the first sensor indicative of the ambient temperature;

compare the ambient temperature to a set point temperature;

in response to a first determination that the ambient temperature is equal to or greater than the set point temperature, adjust the expansion device toward an open position; and in response to a second determination that the ambient temperature is less than the set point temperature, adjust the expansion device toward a closed position.

2. The energy efficient heat pump of claim 1, comprising:

a reversing valve disposed along the working fluid circuit, wherein the reversing valve is adjustable between a first configuration and a second configuration, the reversing valve is configured to direct the working fluid to flow in a first direction along the working fluid circuit in the first configuration and to direct the working fluid to flow in a second direction along the working fluid circuit, opposite the first direction, in the second configuration.

3. The energy efficient heat pump of claim 1, comprising:

a second sensor communicatively coupled to the controller, wherein the second sensor is configured to detect a temperature of the working fluid discharged by the compressor, and wherein the controller is configured to:

receive feedback from the second sensor indicative of the temperature of the working fluid discharged by the compressor; and adjust operation of the expansion device based on the feedback indicative of the temperature of the working fluid discharged by the compressor.

4. The energy efficient heat pump of claim 3, wherein the controller is configured to determine a superheat of the working fluid discharged by the compressor based on the feedback indicative of the temperature of the working fluid discharged by the compressor.

5. The energy efficient heat pump of claim 4, wherein the controller is configured to:

compare the superheat of the working fluid discharged by the compressor to a set point value; and adjust the expansion device to cause the superheat of the working fluid discharged by the compressor to approach the set point value.

6. The energy efficient heat pump of claim 1, wherein the compressor is a scroll compressor.

7. The energy efficient heat pump of claim 1, wherein the suction port of the compressor is configured to receive a primary flow of working fluid from the working fluid circuit, and the first injection port and the second injection port are configured to receive the portion of the working fluid from the injection conduit as a secondary flow of working fluid.

8. The energy efficient heat pump of claim 1, wherein the first injection port and the second injection port are disposed downstream of the suction port relative to a flow direction of working fluid through the compressor.

9. The energy efficient heat pump of claim 1, wherein the expansion device comprises an electronic expansion valve.

10. The energy efficient heat pump of claim 1, wherein the controller is configured to adjust a position of the expansion device based on a speed of the compressor, a temperature of the working fluid discharged by the compressor, a pressure of the working fluid discharged by the compressor, an operating mode of the energy efficient heat pump, or any combination thereof.

11. An energy efficient heat pump for a heating, ventilation, and air conditioning (HVAC) system, comprising:

a compressor disposed along a working fluid circuit, wherein the compressor comprises a suction port configured to receive a first flow of working fluid from the working fluid circuit and a plurality of injection ports configured to receive a second flow of working fluid from an injection conduit extending from the working fluid circuit to the plurality of injection ports, wherein the plurality of injection ports is disposed along the compressor downstream of the suction port relative to a flow direction of working fluid through the compressor;

an expansion device disposed along the injection conduit, wherein the expansion device is configured to reduce a temperature and a pressure of the second flow of working fluid directed to the plurality of injection ports;

a sensor configured to detect an ambient temperature; and a controller communicatively coupled to the sensor and to the expansion device, wherein the controller is configured to:

receive feedback from the sensor indicative of the ambient temperature;

compare the ambient temperature to a set point temperature;

in response to a first determination that the ambient temperature is equal to or greater than the set point temperature, adjust the expansion device toward an open position; and in response to a second determination that the ambient temperature is less than the set point temperature, adjust the expansion device toward a closed position.

12. The energy efficient heat pump of claim 11, comprising:

the working fluid circuit;

a first heat exchanger disposed along the working fluid circuit;

a second heat exchanger disposed along the working fluid circuit; and a liquid conduit portion of the working fluid circuit extending between the first heat exchanger and the second heat exchanger, wherein the injection conduit extends from the liquid conduit portion to the plurality of injection ports of the compressor.

13. The energy efficient heat pump of claim 12, comprising a reversing valve disposed along the working fluid circuit, wherein the reversing valve is adjustable to direct working fluid along the working fluid circuit in a first direction and to direct working fluid along the working fluid circuit in a second direction, opposite the first direction.

14. The energy efficient heat pump of claim 11, wherein the compressor comprises a discharge port configured to discharge a combined flow of the first flow of working fluid and the second flow of working fluid from the compressor.

15. The energy efficient heat pump of claim 14, wherein the controller is configured to operate the expansion device to cause an operating parameter of the combined flow of the first flow of working fluid and the second flow of working fluid to approach a set point value.

16. The energy efficient heat pump of claim 15, wherein the operating parameter is a superheat of the combined flow or a discharge temperature of the combined flow.

17. The energy efficient heat pump of claim 11, wherein the compressor is a variable speed scroll compressor.

18. An energy efficient heat pump for a heating, ventilation, and air conditioning (HVAC) system, comprising:

a working fluid circuit;

a compressor disposed along the working fluid circuit, wherein the compressor is configured to direct a working fluid along the working fluid circuit, and the compressor comprises a suction port, a discharge port, and an injection port disposed between the suction port and the discharge port relative to a flow of the working fluid through the compressor;

an injection conduit extending from the working fluid circuit to the injection port, wherein the injection conduit comprises an expansion device, and the injection conduit is configured to direct a portion of the working fluid from the working fluid circuit to the injection port;

a reversing valve disposed along the working fluid circuit, wherein the reversing valve is adjustable to direct the working fluid along the working fluid circuit in a first direction and to direct the working fluid along the working fluid circuit in a second direction, opposite the first direction;

a sensor configured to detect an ambient temperature; and a controller communicatively coupled to the sensor and to the expansion device, wherein the controller is configured to:

receive feedback from the sensor indicative of the ambient temperature;

compare the ambient temperature to a set point temperature;

in response to a first determination that the ambient temperature is equal to or greater than the set point temperature, adjust the expansion device toward an open position; and in response to a second determination that the ambient temperature is less than the set point temperature, adjust the expansion device toward a closed position.

19. The energy efficient heat pump of claim 18, comprising:

an additional sensor configured to detect an operating parameter of the working fluid discharged by the compressor, wherein the controller is communicatively coupled to the additional sensor, and the controller is configured to:

receive feedback from the additional sensor indicative of the operating parameter of the working fluid discharged by the compressor;

determine a superheat of the working fluid discharged by the compressor based on the operating parameter; and adjust operation of the expansion device to cause the superheat of the working fluid to approach a set point value.

20. The energy efficient heat pump of claim 18, wherein the controller is configured to:

adjust the expansion device toward the open position in response to the first determination in a cooling mode of the energy efficient heat pump;

adjust the expansion device toward the closed position in response to the second determination in the cooling mode of the energy efficient heat pump.

* * * * *